US007252271B2

(12) United States Patent
Stephens

(10) Patent No.: US 7,252,271 B2
(45) Date of Patent: Aug. 7, 2007

(54) PLAY APPARATUS

(76) Inventor: Michael Stephens, 127 Plains Road, Mapperley, Nottingham NG3 5QX (GB)

( * ) Notice: Subject to any disclaimer, the term of this patent is extended or adjusted under 35 U.S.C. 154(b) by 0 days.

(21) Appl. No.: 10/508,171

(22) PCT Filed: Mar. 20, 2003

(86) PCT No.: PCT/GB03/01343

§ 371 (c)(1),
(2), (4) Date: Sep. 17, 2004

(87) PCT Pub. No.: WO03/080205

PCT Pub. Date: Oct. 2, 2003

(65) Prior Publication Data

US 2005/0127251 A1 Jun. 16, 2005

(30) Foreign Application Priority Data

Mar. 21, 2002 (GB) ..... 0206668.6

(51) Int. Cl.
*F16M 11/38* (2006.01)

(52) U.S. Cl. ..... 248/166; 248/167; 248/188; 248/188.6; 472/23

(58) Field of Classification Search ..... 248/188, 248/166, 167, 436, 188.7, 188.6; 108/115, 108/127; 297/16.1, 42; 403/206; 472/23
See application file for complete search history.

(56) References Cited

U.S. PATENT DOCUMENTS

| | | | | | |
|---|---|---|---|---|---|
| 118,478 | A | * | 8/1871 | Parker | 211/85 |
| 143,836 | A | * | 10/1873 | Newcomb | 248/167 |
| 162,131 | A | * | 4/1875 | Willaims | 248/165 |
| 274,330 | A | * | 3/1883 | Houchin | 126/38 |
| 726,787 | A | * | 4/1903 | Turner | 108/173 |
| 927,773 | A | * | 7/1909 | Buel | 108/173 |
| 965,194 | A | * | 7/1910 | Karbiner | 248/167 |
| 1,189,159 | A | * | 6/1916 | Molton | 269/133 |
| 1,979,843 | A | * | 11/1934 | Roos | 108/159 |
| 2,482,979 | A | | 9/1949 | Isakson | |
| 2,606,763 | A | | 8/1952 | Wilson et al. | |
| 2,835,491 | A | | 5/1958 | Meyers | |
| 2,941,800 | A | | 6/1960 | Balch | |
| 3,018,101 | A | * | 1/1962 | Mir et al. | 472/23 |
| 3,043,590 | A | | 7/1962 | Horowitz | |
| 3,207,462 | A | * | 9/1965 | Zimmerman | 248/159 |
| 3,379,145 | A | * | 4/1968 | Lieberman | 108/166 |
| 3,462,140 | A | | 8/1969 | Halaj | |
| 3,558,129 | A | | 1/1971 | Curry | |
| 3,779,176 | A | * | 12/1973 | Piretti | 108/166 |
| 3,924,890 | A | * | 12/1975 | Brennan, Jr. | 297/16.1 |

(Continued)

FOREIGN PATENT DOCUMENTS

FR 2579900 A 10/1986

*Primary Examiner*—Korie Chan
(74) *Attorney, Agent, or Firm*—Nixon Peabody LLP

(57) ABSTRACT

A support for a play apparatus comprising a plurality of legs with each leg having an elongate base member for contacting the ground and an elongate support member arranged substantially perpendicularly to the base member. Each support member is hingably connected to another support member such that the legs are movable between an erected position, in which the support members define an opening for engagement with the play apparatus and the base members extend outwardly from the opening, and a folded position, in which the base members are substantially parallel to each other.

10 Claims, 5 Drawing Sheets

U.S. PATENT DOCUMENTS 4,045,020 A * 8/1977 Townsend ..... 472/23
4,809,619 A * 3/1989 Piretti ..... 108/115
6,234,434 B1 5/2001 Avinger
6,293,512 B1 9/2001 Ho

* cited by examiner

PLAY APPARATUS

This application is a national stage application under 35 U.S.C. § 371 from PCT Application No. PCT/GB03/01343, filed Mar. 20, 2003, which claims the priority benefit of Great Britain Application No. 0206668.6, filed Mar. 21, 2002.

FIELD OF THE INVENTION

This invention relates to play apparatus and in particular to play apparatus such as roundabouts which are easily foldable for compact storage.

BACKGROUND

Large play apparatus such as roundabouts are conventionally intended for outdoor use due to the problem of storage. In particular, roundabouts typically remain erected once assembled. Conventional roundabouts are therefore manufactured to be resistant to erosion from the weather, which is often costly.

Storable roundabouts are difficult to produce principally because of the difficulty in producing a support for the roundabout that may be easily dismantled and stored, yet is also strong and durable enough to support a roundabout. In addition, the support must be large enough to give the roundabout stability in use.

Roundabouts have been produced which include a ratchet mechanism whereby a child can rotate the roundabout by exerting force on a lever whilst seated on the roundabout. Such roundabouts are not easily stored due to the large support required and the complex dismantling process.

There have now been devised improvements to supports for play apparatus and to play apparatus incorporating such supports, which overcome or substantially mitigate the above-mentioned or other disadvantages of the prior art.

SUMMARY

According to a first aspect of the present invention there is provided a support for a play apparatus, the support comprising a plurality of legs, each leg having an elongate base member for contacting the ground and an elongate support member arranged substantially perpendicularly to the base member, each support member being hingably connected to another support member such that the legs are movable between an erected position in which the support members define an opening for engagement with the play apparatus and the base members extend outwardly from the opening, and a folded position in which the base members are substantially parallel to each other.

The support according to the present invention is advantageous principally because of the ease in which the support may be folded into a compact form that is suitable for storage. In addition, a small number of fixing points would be required to secure the support in the erected position, which further improves the ease of use. The foldability of the support renders the play apparatus with which it is used suitable for indoor or outdoor use. The play apparatus can therefore have a lower resistance to weather erosion thereby lowering manufacturing costs.

In a preferred embodiment, the play apparatus is a roundabout, particularly a roundabout that can be rotated by one or more users while sitting on the roundabout, eg by operating a ratchet mechanism as described below.

The legs are preferably secured in the erected position by at least one fixing means which preferably secure together legs that are adjacent in the erected position. The fixing means preferably secures adjacent support members together when the support is in the erected position. A support member may include a plurality of fixing means which are preferably spaced apart along the length of support member. The fixing means is preferably a bracket on a support member with a bolt passing therethrough and engaging with an adjacent support member. Alternative fixing means include a clip or hook located on a support member which may releasably captivate an adjacent support member. The fixing means are preferably located on the support member at either end of the hinged connections.

The support and base members are preferably integrally formed. The legs may be formed of any suitably strong and durable material, which is preferably a metal and most preferably steel. The legs preferably have a box-section, thereby reducing the weight of the legs. The base members of the legs preferably include feet which may be disc-shaped to provide additional stability to the support.

In the erected position, the opening is preferably of a non-circular sectional shape such that any member of similar sectional shape that is closely received within the opening will be prevented from rotating with respect to the support. The support members preferably have flat faces such that, in the erected position, the opening is of polygon section. The support members are preferably of square section and the support preferably comprises four legs such that a square section opening is defined of preferably similar sectional dimensions to the support members.

According to a further aspect of the invention there is provided a play apparatus comprising a support according to the present invention in the erected position, a play apparatus support member which is closely received within the opening, and a play apparatus structure mounted on the play apparatus support member.

The opening and the play apparatus support member are preferably of non circular sectional shape such that the play apparatus support member is prevented from rotating with respect to the support. The support members of the legs and the play apparatus support member are preferably of square section and the support preferably comprises four legs such that a square section opening is defined of preferably similar sectional dimensions to the play apparatus support member.

Where the play apparatus is a roundabout, the play apparatus structure preferably includes a mechanism which is operably linked to the play apparatus support member. Such a mechanism preferably allows a child, who is supported by the play apparatus structure, to impart a rotational force on the play apparatus structure with respect to the play apparatus support member and hence the support. The mechanism preferably includes a ratchet but the mechanism may be any which allows a child to impart a force as hereinbefore described.

BRIEF DESCRIPTION OF THE DRAWINGS

The invention will now be described in greater detail, by way of illustration only, with reference to the accompanying drawings, in which.

DETAILED DESCRIPTION

Figure 1:
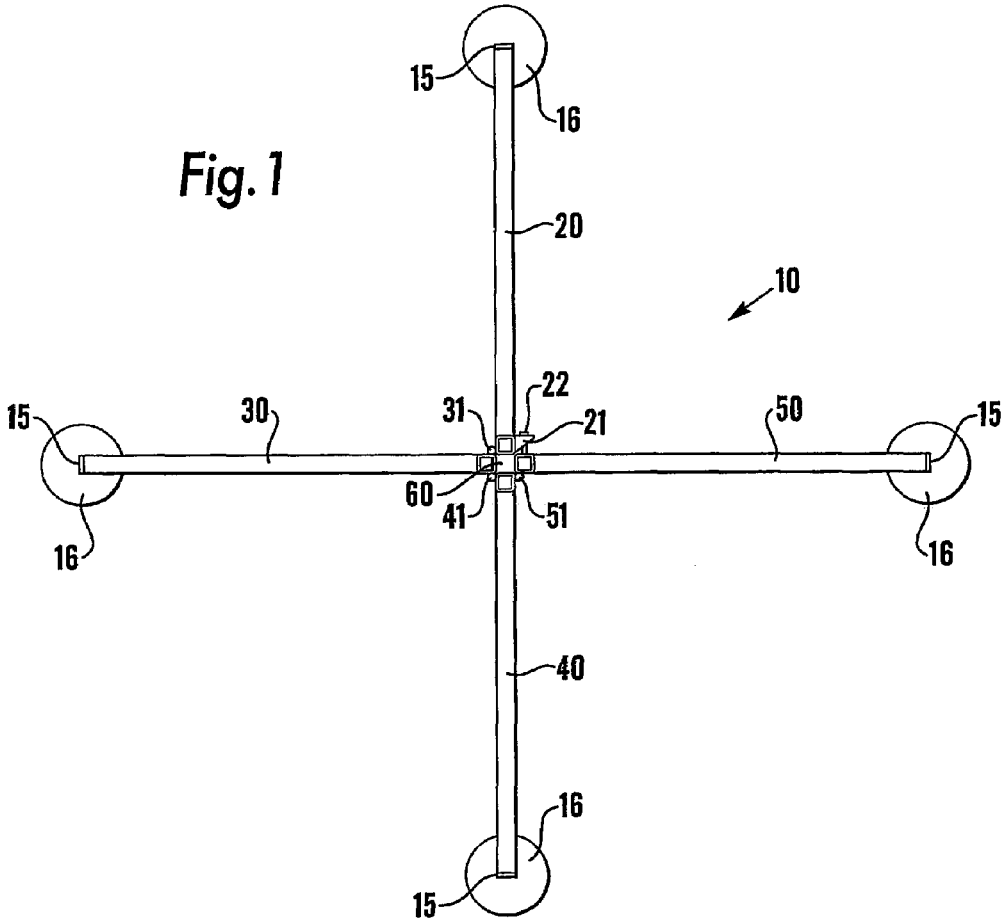
FIG. 1 is a plan view of a stand according to the present invention.
Figure 2:
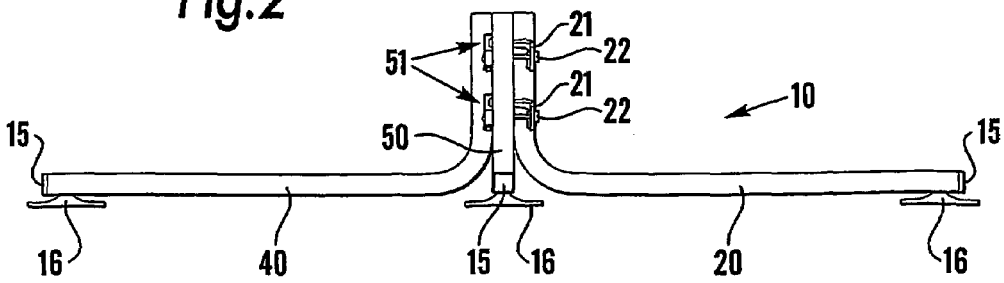
FIG. 2 is a frontal view of the stand of FIG. 1.

Referring firstly to FIGS. 1 and 2, a stand according to the present invention is generally designated 10 and comprises four legs 20,30,40,50. The stand may be formed of any suitably strong and durable material and preferably a metal. In such a case, the attached components are commonly welded together.

The legs 20,30,40,50 are formed from square-section hollow tubes with rounded longitudinal edges. The legs 20,30,40,50 each comprise a straight base member which arcs at one end to form a shorter straight upright member perpendicularly aligned with respect to the base member. The two side faces of each leg 20,30,40,50 are flat.

The legs 20,30,40,50 of the stand are orientated so that the base members are substantially parallel to the supporting surface and the upright members are vertically aligned. The legs 20,30,40,50 are arranged so that the upright members are adjacent each other, thereby forming a central support, and the base members extend outwardly from the central support at right angles to each other. The open end of each base member includes a plug 15 of plastics material. Each leg 20,30,40,50 is typically 350 mm in height and 900 m in length. The square-section hollow tube from which each leg 20,30,40,50 is formed has typical sectional dimensions of 25 mm by 25 mm. Each base member includes a removable foot 16 of a disc shape which contacts the supporting surface, thereby giving the stand additional support.

Figure 3:
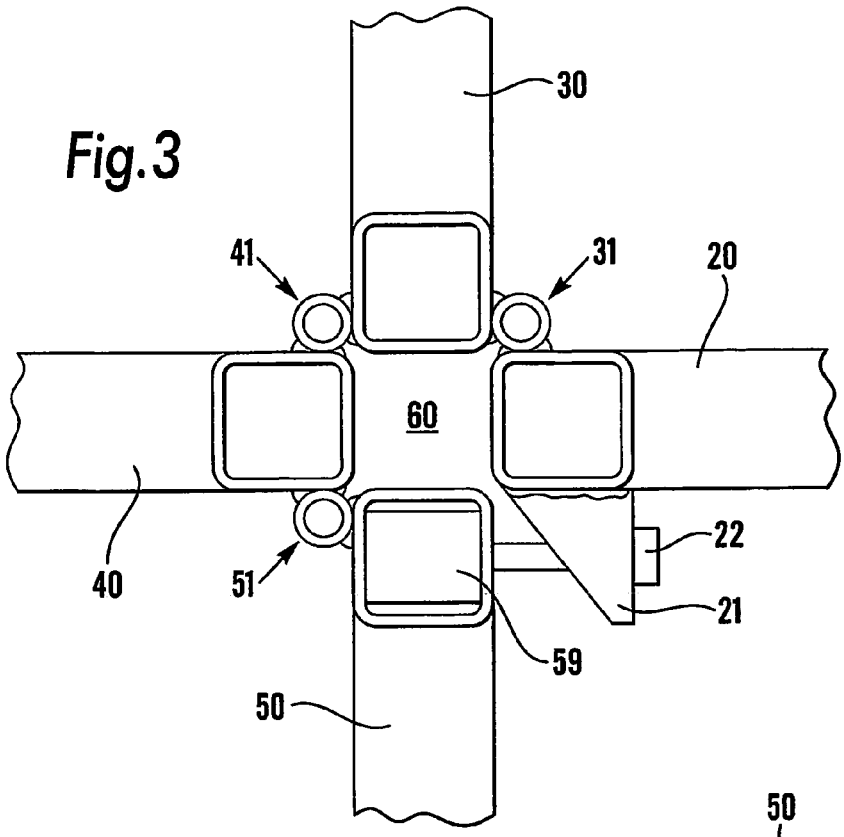
FIG. 3 is a view similar to FIG. 1 of a central portion of the stand on an enlarged scale.
Figure 4:
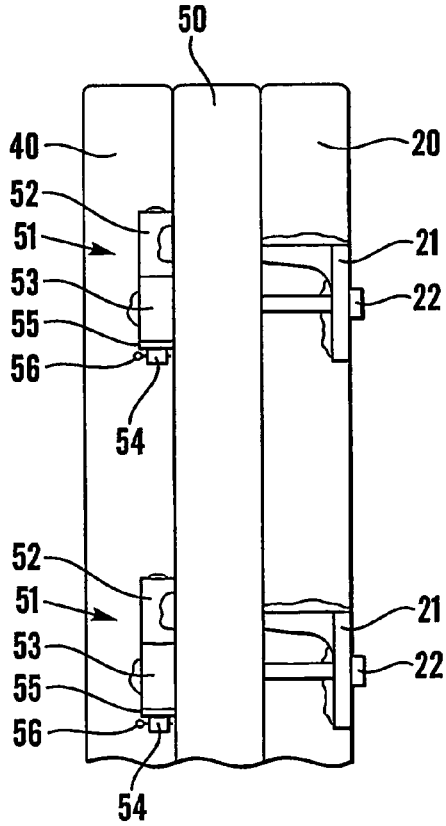
FIG. 4 is a view similar to FIG. 2 of a central portion of the stand on an enlarged scale.

Referring now to FIGS. 3 and 4, the legs 20,30,40,50 of the stand form a vertical square-section opening 60 at the interface of the upright members. The opening 60 is of similar sectional dimensions to the legs 20,30,40,50.

The upright member of leg 40 is connected to the upright member of leg 50 by a pair of hinges 51. Each hinge 51 comprises an upper cylinder 52 which is fixed to leg 50 and a lower cylinder 53 which is fixed to leg 40. The cylinders 52,53 are juxtaposed and have a longitudinal bore through which a bolt 54 extends. The bolt 54 is fixed within the upper cylinder 52 and is rotatable within the lower cylinder 53. The bolt 54 extends beyond the lower edge of the lower cylinder 53 and includes an aperture through which a pin 56 passes. A washer 55 is mounted on the bolt 54 between the lower cylinder 53 and the pin 55. The pin 55 restricts the longitudinal movement of the bolt 54 within the lower cylinder 53. Similarly, leg 30 is connected to leg 40 by a pair of hinges 41 and leg 20 is connected to leg 30 by a pair of hinges 31.

Leg 20 includes a pair of spaced apart fixing brackets 21. Each fixing bracket 21 has a vertically aligned plate with a bolt hole. Leg 50 includes a pair of corresponding bolt holes which are in registration with the bolt holes of the fixing brackets 21. A pair of fixing cylinders 59, each with a threaded bore, are located within leg 50 and orientated so that each threaded bore is aligned with corresponding bolt holes of the leg 50 and the fixing bracket 21. Each fixing bracket 21 and corresponding bolt hole of leg 50 has a threaded bolt 22 passing therethrough and engaging with the threaded bore of the respective fixing cylinder 59, thereby fixing legs 20 and 50 together. Other suitable methods of removably fixing legs 20 and 50 together could be used such as using nuts and bolts, clips or hooks.

Figure 5:
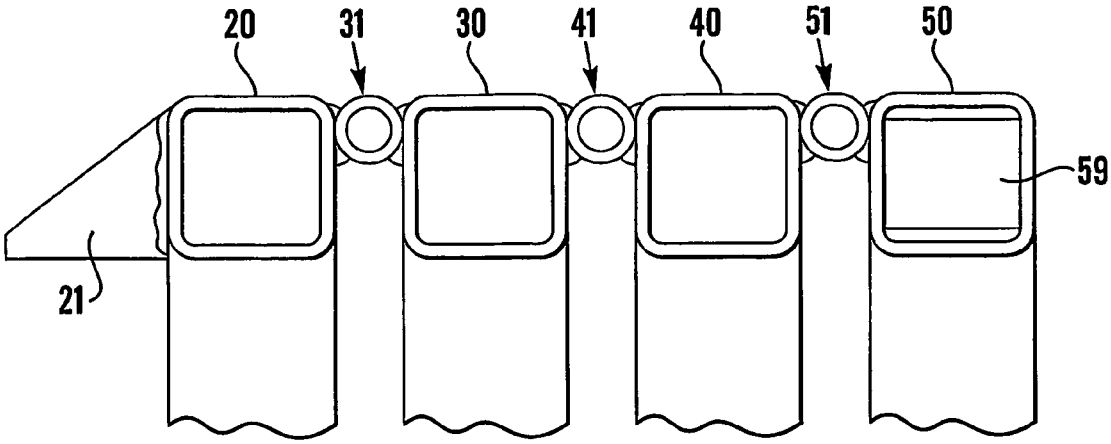
FIG. 5 is a view similar to FIG. 3 of the stand in a folded arrangement.
Figure 6:
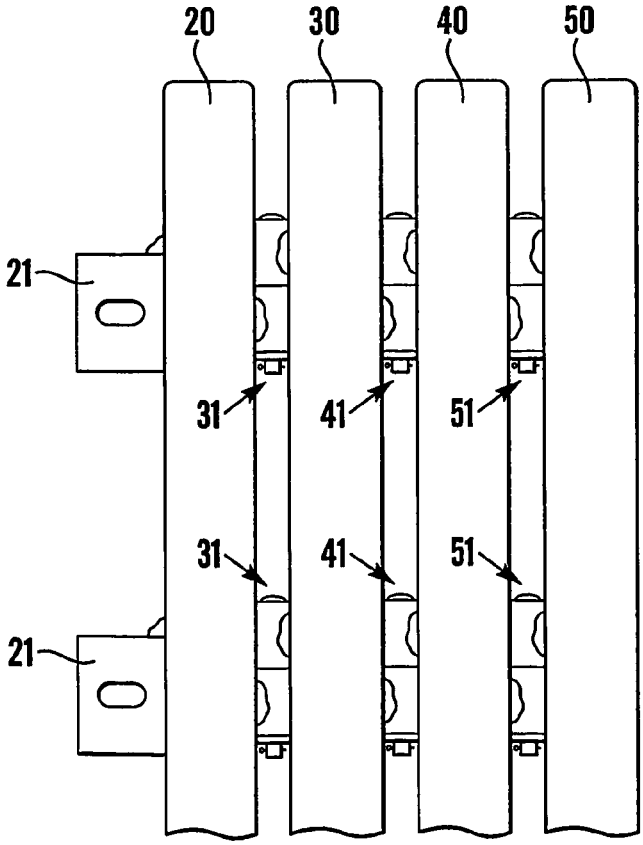
FIG. 6 is a view similar to FIG. 4 of the stand in a folded arrangement.
Figure 7:
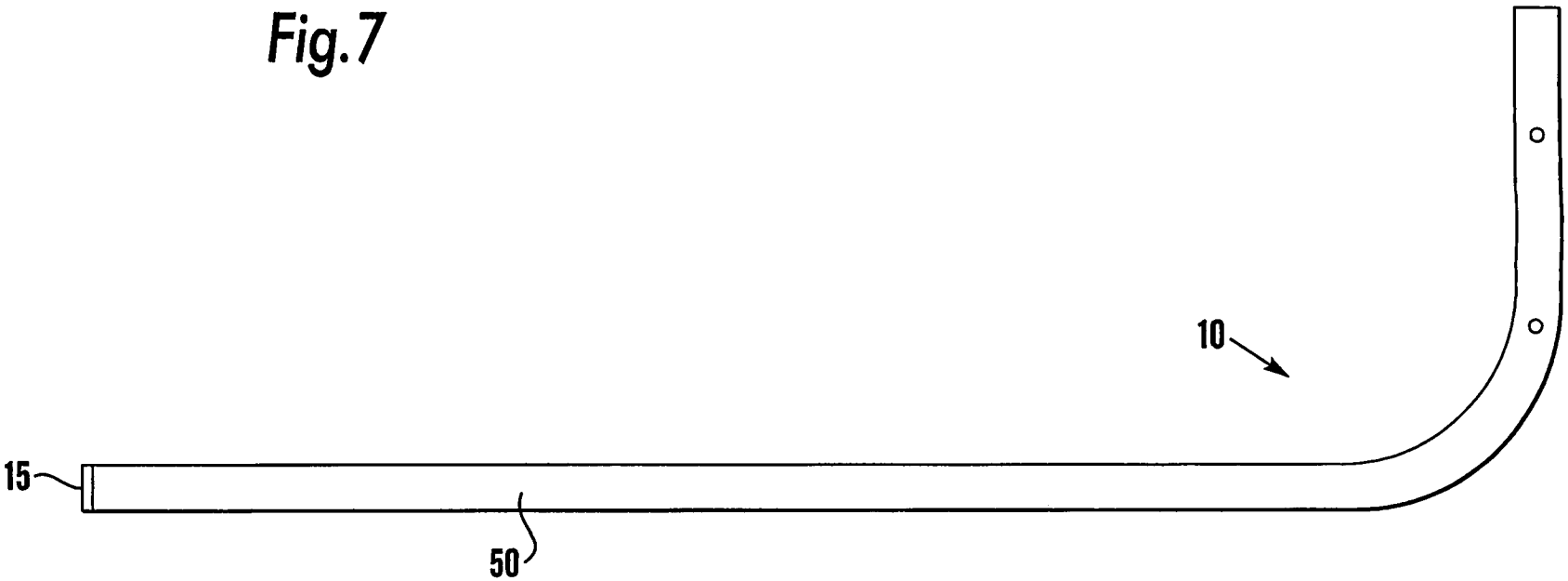
FIG. 7 is a side view of the folded stand of FIGS. 5 and 6.

Turning now to FIGS. 5, 6 and 7, the stand 15 is easily folded by removing the pair of bolts 22 and rotating the legs 20,30,40,50 so that the base members of the legs 20,30,40,50 are substantially parallel and adjacent to each other. The ease with which the stand 15 is folded is a significant advantage of the present invention.

Figure 8:
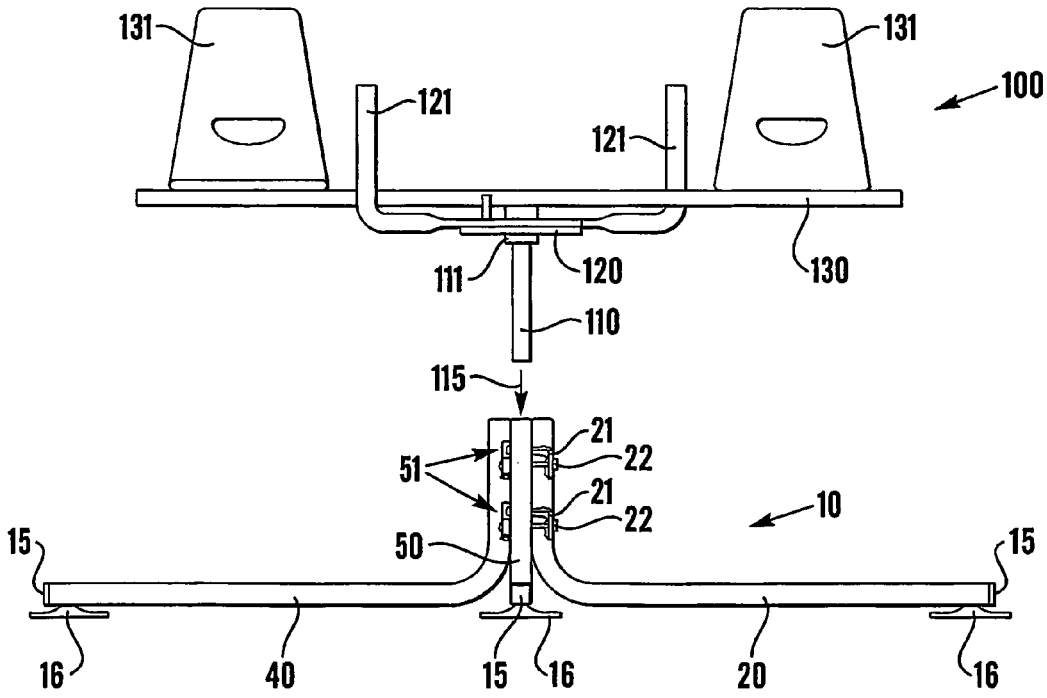
FIG. 8 is an exploded frontal view of a roundabout according to the present invention.

Referring now to FIG. 8, a roundabout according to the present invention is generally designated 100 and comprises the stand 10, a central support 110, a disc 111 fixed at the upper end of the central support 110, a ratchet mechanism 120, two operating levers 121, a cross arm 130 and two chairs 131. The roundabout 100 is commonly formed in a material similar to that of the stand 10. The chairs 131 are preferably moulded in a plastics material.

The central support 110 is a square-section hollow tube of slightly smaller sectional dimensions to the legs 20,30,40,50. The central support 110 is closely received, along arrow 115, within the opening 60 and the disc 111 is supported by the ends of the upright members of the legs 20,30,40,50. The shape of the central support 110 and the opening 60 prevents rotation of the central support 110 within the stand 10.

The central support 110 and the two operating levers 121 are operably connected to the ratchet mechanism 120 such that anticlockwise rotation (viewed from above) of the two operating levers 121 with respect to the central support 110 and the stand 10 is permitted but clockwise rotation is prevented. The chairs 131 are fastened to either end of the cross arm 130 and aligned so as to face anticlockwise (viewed from above). The centre of the cross arm 130 is pivotally mounted within the ratchet mechanism 120 and is free to rotate in a horizontal plane. A ratchet mechanism 120 that functions as hereinbefore described is conventional and well known in the art. The ratchet mechanism 120 could be replaced by any other mechanism that performs this same function.

In use, a child sits in a chair 131 and exerts force on the operating lever 121 towards the child. Since clockwise rotation of the levers 121 with respect to the central support 110 is prevented, the force exerted on the levers 121 causes the cross arm 130 to rotate anticlockwise with respect to the central support 110. The lever 121 is then held either by the child or by the cross arm 130 abutting a stop 122 located on the ratchet mechanism 120. The lever 121 therefore rotates anticlockwise with the cross arm 130. Subsequent force exerted on the lever 121 by the child in a clockwise direction with respect to the central support 110 will exert a further rotational force on the cross arm 130. The two chairs 131 and levers 121 allow two users to operate the roundabout 100 simultaneously.

The invention claimed is:

1. A play apparatus, comprising a support having a plurality of legs, each leg having an elongate base member for contacting the ground and an elongate support member arranged substantially perpendicularly to the base member, each support member being hingably connected to another support member such that the legs are movable between an erected position in which the support members define an opening for engagement with the play apparatus, a perimeter of the opening consists of the support members, and the base members extend outwardly from the opening, and a folded position in which the base members are substantially parallel and adjacent to each other, and a roundabout mounted on a play apparatus support member that is closely received within the opening when the support members are in the erected position, wherein the opening and the play apparatus support member are of non-circular sectional shape such that the play apparatus support member is prevented from rotating with respect to the support, and the roundabout includes a mechanism which is operably linked to the play apparatus support member and allows a child, who is supported by the roundabout, to impart a rotational force on the roundabout with respect to the play apparatus support member and the support.

2. The play apparatus as claimed in claim 1, wherein the legs are secured in the erected position by at least one fixing device.

3. The play apparatus as claimed in claim 2, wherein the fixing device secures adjacent support members together when the support is in the erected position.

4. The play apparatus as claimed in claim 3, wherein one of the support members includes a plurality of fixing devices spaced apart along the length of the one of the support members.

5. The play apparatus as claimed in claim 3, wherein the fixing device is a bracket on one of the support members with a bolt passing therethrough and engaging with an adjacent support member.

6. The play apparatus as claimed in claim 3, wherein the fixing device is located on the support members at either end of the hinged connections.

7. The play apparatus as claimed in claim 1, wherein the legs have a box-section.

8. The play apparatus as claimed in claim 1, wherein the base members of the legs further comprise one or more feet to provide additional stability to the support.

9. The play apparatus as claimed in claim 1, wherein the support members have flat faces such that, in the erected position, the opening is of polygon section.

10. The play apparatus as claimed in claim 9, wherein the support members have a substantially square sectional shape and the support comprises four legs such that the opening has a substantially square sectional shape.

* * * * *